US011873587B2

(12) United States Patent
Adams et al.

(10) Patent No.: US 11,873,587 B2
(45) Date of Patent: Jan. 16, 2024

(54) FLAME RESISTANT FABRICS

(71) Applicant: Southern Mills, Inc., Union City, GA (US)

(72) Inventors: Dominique Janay Adams, Fairburn, GA (US); Charles S. Dunn, Griffin, GA (US); Elijah Dufty, Atlanta, GA (US); Michael T. Stanhope, Atlanta, GA (US)

(73) Assignee: Southern Mills, Inc., Union City, GA (US)

( * ) Notice: Subject to any disclaimer, the term of this patent is extended or adjusted under 35 U.S.C. 154(b) by 436 days.

(21) Appl. No.: 17/175,647

(22) Filed: Feb. 13, 2021

(65) Prior Publication Data

US 2021/0164133 A1 Jun. 3, 2021

Related U.S. Application Data

(62) Division of application No. 16/832,991, filed on Mar. 27, 2020.

(60) Provisional application No. 62/825,350, filed on Mar. 28, 2019.

(51) Int. Cl.
*D02G 3/44* (2006.01)
*D03D 15/513* (2021.01)

(52) U.S. Cl.
CPC ..... *D02G 3/443* (2013.01); *D03D 15/513* (2021.01); *D10B 2201/20* (2013.01); *D10B 2321/101* (2013.01); *D10B 2331/021* (2013.01); *Y10T 442/3984* (2015.04)

(58) Field of Classification Search
None
See application file for complete search history.

(56) References Cited

U.S. PATENT DOCUMENTS

| | | | |
|---|---|---|---|
| 2,333,824 | A | 11/1943 | Schoepf |
| 2,696,723 | A | 12/1954 | Frith, Jr. |
| 3,097,442 | A | 7/1963 | Willingham, Jr. |
| 3,729,920 | A | 5/1973 | Sayers et al. |
| 3,763,644 | A | 10/1973 | Jackson, Jr. et al. |
| 3,806,959 | A | 4/1974 | Gross |
| 3,918,901 | A | 11/1975 | Ida et al. |
| 4,533,592 | A | 8/1985 | Bingham |
| 4,615,934 | A | 10/1986 | Ellison |
| 4,668,234 | A | 5/1987 | Vance et al. |
| 4,705,523 | A | 11/1987 | Hussamy |
| 4,705,527 | A | 11/1987 | Hussamy |
| 4,710,200 | A | 12/1987 | Cates et al. |
| 4,741,740 | A | 5/1988 | Davis et al. |
| 4,752,300 | A | 6/1988 | Johnson |
| 4,759,770 | A | 7/1988 | Cates et al. |
| 4,814,222 | A | 3/1989 | Davis et al. |
| 4,868,041 | A | 9/1989 | Yamagishi et al. |
| 4,898,596 | A | 2/1990 | Riggins et al. |
| 4,902,300 | A | 2/1990 | Johnson et al. |
| 4,920,000 | A | 4/1990 | Green |
| 4,970,255 | A | 11/1990 | Reimann et al. |
| 4,981,488 | A | 1/1991 | Cates et al. |
| 4,996,099 | A | 2/1991 | Cooke et al. |
| 5,043,207 | A | 8/1991 | Donovan et al. |
| 5,074,889 | A | 12/1991 | Hodge et al. |
| 5,141,542 | A | 8/1992 | Fangeat et al. |
| 5,150,476 | A | 9/1992 | Statham et al. |
| 5,174,790 | A | 12/1992 | Riggins et al. |
| 5,208,105 | A | 5/1993 | Ichibori et al. |
| 5,215,545 | A | 6/1993 | Cates et al. |
| 5,275,627 | A | 1/1994 | Cates et al. |
| 5,306,312 | A | 4/1994 | Riggins et al. |
| 5,323,815 | A | 6/1994 | Barbeau et al. |
| 5,356,700 | A | 10/1994 | Tanaka et al. |
| 5,447,540 | A | 9/1995 | Kobayashi et al. |
| 5,456,728 | A | 10/1995 | Schwarz et al. |
| 5,466,265 | A | 11/1995 | Riegels et al. |

(Continued)

FOREIGN PATENT DOCUMENTS

| | | | |
|---|---|---|---|
| AU | 2005200963 | A1 | 3/2005 |
| AU | 2007290499 | B2 | 7/2012 |

(Continued)

OTHER PUBLICATIONS

PCT Patent Application No. PCT/US2020/025434, International Search Report and Written Opinion, dated Aug. 17, 2020, 15 pages.
Restriction Requirement, U.S. Appl. No. 16/832,991, dated Dec. 14, 2020, 5 pages.
U.S. Appl. No. 16/832,991, Non-Final Office Action, dated Jun. 7, 2022, 15 pages.
Office Action, Japanese Patent Application No. 2021-557646, Office Action, dated Apr. 12, 2022, 4 pages.
Office Action, Chinese Patent Application No. 202080039337.7, dated Nov. 21, 2022, 26 pages.

(Continued)

*Primary Examiner* — Jenna L Johnson

(74) *Attorney, Agent, or Firm* — Kilpatrick Townsend & Stockton LLP

(57) ABSTRACT

Embodiments of the present invention relate to flame resistant fabrics formed with inherently flame resistant fibers that provide the requisite thermal and arc protection, that have improved comfort, and that, in some embodiments, are less expensive than other fabrics formed with inherently flame resistant fibers. Improved comfort and lower cost can be achieved by predominantly locating the inherently flame resistant fibers on the front face of the fabric to impart the requisite thermal and arc protection and predominantly locating the more comfortable (and less expensive) fibers on the back face of the fabric positioned next to the wearer. In this way, overall protection of the fabric is maintained while improving comfort. Some embodiments of such fabrics may also achieve NFPA 70E PPE Category 2 protection.

9 Claims, No Drawings

(56) References Cited

U.S. PATENT DOCUMENTS 5,488,101 A 1/1996 Ogino et al.
5,514,457 A 5/1996 Fels et al.
5,527,597 A 6/1996 Stanhope et al.
5,539,928 A 7/1996 Aldridge
5,578,368 A 11/1996 Forsten et al.
5,609,950 A 3/1997 Kampl et al.
5,640,718 A 6/1997 Aldridge
5,685,015 A 11/1997 Aldridge
5,694,981 A 12/1997 Stanhope et al.
5,724,673 A 3/1998 Aldridge
5,727,401 A 3/1998 Statham
5,776,746 A 7/1998 Denney, Jr.
5,819,316 A 10/1998 Aldridge
5,824,614 A 10/1998 Gadoury
5,830,574 A 11/1998 Gadoury
5,849,648 A 12/1998 Kent et al.
5,858,888 A 1/1999 Underwood et al.
5,885,307 A 3/1999 Gadoury
5,891,813 A 4/1999 Gadoury
5,906,891 A 5/1999 Shida et al.
5,920,905 A 7/1999 Aldridge
5,928,971 A 7/1999 Ellis et al.
6,132,476 A 10/2000 Lunsford et al.
6,146,759 A 11/2000 Land
6,184,282 B1 2/2001 Gareiss et al.
6,192,520 B1 2/2001 Underwood et al.
6,225,383 B1 5/2001 Hirono et al.
6,247,179 B1 6/2001 Underwood et al.
6,255,371 B1 7/2001 Schlosser et al.
6,342,548 B2 1/2002 Flippo et al.
6,410,140 B1 6/2002 Land et al.
6,430,754 B1 8/2002 Taylor et al.
6,451,070 B1 9/2002 Kent et al.
6,534,175 B1 3/2003 Zhu et al.
6,547,835 B1 4/2003 Lunsford et al.
6,626,964 B1 9/2003 Lunsford et al.
6,668,868 B2 12/2003 Howland et al.
6,693,052 B2 2/2004 Howland
6,706,650 B2 3/2004 Gibson et al.
6,735,789 B2 5/2004 Kelleher et al.
6,787,228 B2 9/2004 Campbell et al.
6,818,024 B2 11/2004 Lunsford et al.
6,840,288 B2 1/2005 Zhu et al.
6,861,378 B2 3/2005 Cunningham et al.
6,867,154 B1 3/2005 Lunsford et al.
6,946,412 B2 9/2005 Campbell et al.
6,974,785 B1 12/2005 Barbeau et al.
7,013,496 B2 3/2006 Dunn
7,065,950 B2 6/2006 Zhu et al.
7,073,538 B2 7/2006 Bhatnagar et al.
7,156,883 B2 1/2007 Lovasic et al.
7,284,398 B2 10/2007 Hubner
7,393,800 B2 7/2008 Corner
7,402,538 B2 7/2008 Bader et al.
7,473,659 B2 1/2009 Sytz
7,589,036 B2 9/2009 Corner et al.
7,634,819 B2 12/2009 Grey
7,676,855 B2 3/2010 Dunn
7,681,417 B2 3/2010 Hagihara et al.
7,703,405 B2 4/2010 Bridgeman et al.
7,854,017 B2 12/2010 Laton
7,862,865 B2 1/2011 Truesdale, III et al.
RE42,209 E 3/2011 Lunsford et al.
8,017,532 B2 9/2011 Okada
8,071,492 B2 12/2011 Hess et al.
8,133,584 B2 3/2012 Zhu
8,327,469 B2 12/2012 Curtis
8,347,420 B2 1/2013 Kruszewski et al.
8,528,120 B2 9/2013 Underwood et al.
8,536,076 B1 9/2013 Byles
8,614,156 B2 12/2013 Hess et al.
8,652,975 B1 2/2014 Atkinson et al.
8,703,631 B2 4/2014 Sytz
8,741,789 B2 6/2014 Li et al.
8,898,821 B2 12/2014 Stanhope et al.
9,034,777 B2 5/2015 Hines et al.
9,259,599 B2 2/2016 Stanhope et al.
9,370,212 B2 6/2016 Zhu
9,683,315 B2 6/2017 Schmitt et al.
9,706,804 B1 7/2017 Emery et al.
9,765,454 B2 9/2017 Tutterow et al.
9,878,185 B2 1/2018 Underwood et al.
9,938,645 B2 4/2018 Stanhope et al.
9,988,745 B2 6/2018 Sanchez et al.
10,030,326 B2 7/2018 Hines, Jr. et al.
10,072,365 B2 9/2018 Birk et al.
10,101,128 B2 10/2018 Cushingham et al.
10,183,465 B1 1/2019 Bowman et al.
10,316,440 B2 6/2019 Stanhope et al.
10,385,481 B2 8/2019 Underwood et al.
10,422,055 B2 9/2019 Sytz
10,485,281 B2 11/2019 Stanhope et al.
10,487,424 B2 11/2019 Stanhope et al.
10,640,893 B2 5/2020 Sarzotti et al.
10,704,169 B2 7/2020 Habicht et al.
10,774,451 B2 9/2020 Stanhope et al.
10,870,932 B2 12/2020 Stanhope et al.
11,306,418 B2 4/2022 Stanhope et al.
11,421,348 B2 8/2022 Stanhope et al.
2001/0009832 A1 7/2001 Shaffer et al.
2002/0016985 A1 2/2002 Kelleher et al.
2002/0064654 A1 5/2002 Luo et al.
2002/0069453 A1 6/2002 Kelleher et al.
2002/0182967 A1 12/2002 Erb, Jr. et al.
2003/0082972 A1 5/2003 Monfalcone, III et al.
2003/0098068 A1 5/2003 Chi et al.
2003/0148689 A1 8/2003 Lapierre
2003/0167580 A1 9/2003 Lunsford et al.
2003/0226612 A1 12/2003 Zhu et al.
2003/0228812 A1 12/2003 Stanhope et al.
2003/0228821 A1 12/2003 Zhu et al.
2003/0232560 A1 12/2003 Corner
2004/0001978 A1 1/2004 Bader et al.
2004/0029473 A1 2/2004 McKee et al.
2004/0045103 A1 3/2004 Lunsford et al.
2004/0065072 A1 4/2004 Zhu et al.
2004/0076824 A1 4/2004 Urabe et al.
2004/0152378 A1 8/2004 Stanhope et al.
2004/0192134 A1 9/2004 Gibson et al.
2005/0025962 A1 2/2005 Zhu et al.
2005/0025963 A1 2/2005 Zhu
2005/0032449 A1 2/2005 Lovasic et al.
2005/0050619 A1 3/2005 Dunn
2005/0060820 A1 3/2005 Lunsford et al.
2005/0064020 A1 3/2005 Schuette et al.
2005/0119379 A1 6/2005 Martens et al.
2005/0197028 A1 9/2005 Hartgrove et al.
2005/0208855 A1 9/2005 Zhu
2005/0245163 A1 11/2005 Aneja et al.
2005/0287364 A1 12/2005 Zhu et al.
2006/0030228 A1 2/2006 Truesdale, III
2006/0040575 A1 2/2006 Kelleher et al.
2006/0068664 A1 3/2006 Gibson et al.
2006/0084337 A1 4/2006 Corner et al.
2006/0116043 A1 6/2006 Hope et al.
2006/0143809 A1 7/2006 Dunn
2006/0264136 A1 11/2006 Chiantese
2006/0266986 A1 11/2006 Day et al.
2006/0292953 A1 12/2006 Ashley et al.
2007/0026752 A1 2/2007 Thiriot et al.
2007/0123127 A1 5/2007 Hirschmann, Jr. et al.
2007/0148455 A1 6/2007 Ke
2007/0178788 A1 8/2007 Link et al.
2007/0184737 A1 8/2007 Corner et al.
2007/0248765 A1 10/2007 Truesdale et al.
2007/0249247 A1 10/2007 Truesdale, III et al.
2007/0249250 A1 10/2007 Servajean
2008/0057807 A1* 3/2008 Tutterow ..... A41D 31/08 428/221
2008/0086798 A1 4/2008 Allen, II et al.
2008/0139752 A1 6/2008 De et al.
2008/0148468 A1 6/2008 Laton et al.
2008/0152888 A1 6/2008 Tutterow et al.
2008/0182470 A1 7/2008 Fang et al.

(56) References Cited

U.S. PATENT DOCUMENTS

| | | | |
|---|---|---|---|
| 2008/0227352 | A1 | 9/2008 | Byles et al. |
| 2008/0295232 | A1 | 12/2008 | Truesdale, III et al. |
| 2009/0030111 | A1 | 1/2009 | Barnes et al. |
| 2009/0139016 | A1 | 6/2009 | Zhu et al. |
| 2009/0178186 | A1 | 7/2009 | Truesdale |
| 2009/0226653 | A1 | 9/2009 | Harris et al. |
| 2009/0255038 | A1 | 10/2009 | Curtis |
| 2010/0009186 | A1 | 1/2010 | Zhu |
| 2010/0024103 | A1 | 2/2010 | Kelleher et al. |
| 2010/0075557 | A1 | 3/2010 | Shteiyer |
| 2010/0112312 | A1 | 5/2010 | Tutterow et al. |
| 2010/0143683 | A1 | 6/2010 | Chiou |
| 2010/0210162 | A1 | 8/2010 | Li et al. |
| 2010/0297905 | A1* | 11/2010 | Ulrich ..... D03D 15/513 442/302 |
| 2010/0299816 | A1 | 12/2010 | Zhu |
| 2010/0299817 | A1 | 12/2010 | Zhu |
| 2011/0010827 | A1* | 1/2011 | Stanhope ..... D02G 3/443 2/81 |
| 2011/0023206 | A1 | 2/2011 | Dunn et al. |
| 2011/0138523 | A1 | 6/2011 | Layson, Jr. et al. |
| 2011/0159364 | A1 | 6/2011 | Nishinaka et al. |
| 2011/0250810 | A1 | 10/2011 | Zhu |
| 2011/0275263 | A1 | 11/2011 | Li et al. |
| 2011/0281097 | A1 | 11/2011 | Li et al. |
| 2012/0031783 | A1 | 2/2012 | Fay, III et al. |
| 2012/0090080 | A1 | 4/2012 | Stanhope et al. |
| 2012/0102632 | A1 | 5/2012 | Zhu |
| 2012/0122361 | A1 | 5/2012 | Hand et al. |
| 2012/0159697 | A1 | 6/2012 | Zhu |
| 2012/0171918 | A1 | 7/2012 | Lawson, III et al. |
| 2012/0183747 | A1 | 7/2012 | Bader et al. |
| 2012/0210481 | A1 | 8/2012 | Rock et al. |
| 2012/0244772 | A1 | 9/2012 | Elder |
| 2012/0270456 | A1 | 10/2012 | Gstettner et al. |
| 2012/0286177 | A1 | 11/2012 | Cliver et al. |
| 2013/0008554 | A1 | 1/2013 | Fisher et al. |
| 2013/0055490 | A1 | 3/2013 | Zhu |
| 2013/0055491 | A1 | 3/2013 | Zhu |
| 2013/0065470 | A1 | 3/2013 | Rock et al. |
| 2013/0149932 | A1 | 6/2013 | Leitner et al. |
| 2013/0212790 | A1 | 8/2013 | Waxman et al. |
| 2013/0216810 | A1 | 8/2013 | Hines et al. |
| 2013/0244527 | A1 | 9/2013 | Sarzotti et al. |
| 2014/0026303 | A1 | 1/2014 | Zhu |
| 2014/0187113 | A1 | 7/2014 | Hines, Jr. et al. |
| 2014/0208491 | A1 | 7/2014 | Schmitt et al. |
| 2014/0261852 | A1 | 9/2014 | Bonner et al. |
| 2015/0086758 | A1 | 3/2015 | Tutterow et al. |
| 2015/0297919 | A1 | 10/2015 | Stanhope et al. |
| 2015/0322598 | A1 | 11/2015 | Stanhope et al. |
| 2015/0361599 | A1 | 12/2015 | Minor |
| 2016/0201236 | A1 | 7/2016 | Matsumoto et al. |
| 2016/0362831 | A1 | 12/2016 | Minor |
| 2017/0175302 | A1 | 6/2017 | Habicht et al. |
| 2017/0203540 | A1 | 7/2017 | Colatruglio et al. |
| 2017/0295875 | A1 | 10/2017 | Ohzeki et al. |
| 2017/0370032 | A1 | 12/2017 | Stanhope et al. |
| 2018/0002840 | A1 | 1/2018 | Tutterow et al. |
| 2018/0030627 | A1 | 2/2018 | Stanhope et al. |
| 2018/0127899 | A1 | 5/2018 | Tutterow et al. |
| 2018/0171516 | A1 | 6/2018 | Stanhope et al. |
| 2018/0245251 | A1 | 8/2018 | Dash et al. |
| 2018/0274136 | A1 | 9/2018 | Guo et al. |
| 2018/0313006 | A1 | 11/2018 | Stanhope et al. |
| 2018/0371647 | A1 | 12/2018 | Sato et al. |
| 2019/0242038 | A1 | 8/2019 | Stanhope et al. |
| 2019/0301059 | A1 | 10/2019 | Flack et al. |
| 2019/0309451 | A1 | 10/2019 | King et al. |
| 2020/0308735 | A1 | 10/2020 | Adams et al. |
| 2021/0292936 | A1 | 9/2021 | Ringo |

FOREIGN PATENT DOCUMENTS

| | | | |
|---|---|---|---|
| BE | 1015931 | | 11/2005 |
| CA | 2078626 | C | 4/1999 |
| CN | 1172508 | A | 2/1998 |
| CN | 1201474 | A | 12/1998 |
| CN | 1575359 | A | 2/2005 |
| CN | 1950455 | A | 4/2007 |
| CN | 101166852 | A | 4/2008 |
| CN | 101263253 | A | 9/2008 |
| CN | 101326315 | A | 12/2008 |
| CN | 101611182 | A | 12/2009 |
| CN | 101657573 | A | 2/2010 |
| CN | 101754998 | A | 6/2010 |
| CN | 102859055 | A | 1/2013 |
| CN | 102995224 | A | 3/2013 |
| CN | 103221597 | A | 7/2013 |
| CN | 103603123 | A | 2/2014 |
| CN | 103857837 | A | 6/2014 |
| CN | 104685118 | A | 6/2015 |
| CN | 105220314 | B | 3/2017 |
| CN | 107034574 | A | 8/2017 |
| CN | 107075752 | A | 8/2017 |
| CN | 108474147 | A | 8/2018 |
| CN | 110760978 | A | 2/2020 |
| DE | 202004005008 | U1 | 6/2004 |
| DE | 202010011193 | U1 | 12/2010 |
| EP | 0330163 | A2 | 8/1989 |
| EP | 0364194 | A2 | 4/1990 |
| EP | 0559128 | A1 | 9/1993 |
| EP | 0412195 | B1 | 6/1995 |
| EP | 1247885 | | 10/2002 |
| EP | 1754813 | A1 | 2/2007 |
| EP | 1767677 | A1 | 3/2007 |
| EP | 2096199 | A1 | 9/2009 |
| EP | 1498522 | B1 | 9/2010 |
| EP | 2567945 | A2 | 3/2013 |
| EP | 2738294 | A1 | 6/2014 |
| EP | 3425093 | A1 | 1/2019 |
| EP | 3831992 | B1 | 1/2022 |
| FR | 2514934 | A1 | 4/1983 |
| FR | 2691721 | A1 | 12/1993 |
| FR | 2836932 | A1 | 9/2003 |
| GB | 1126432 | | 9/1968 |
| GB | 2025789 | A | 1/1980 |
| JP | H01-221537 | A | 9/1989 |
| JP | 02127466 | A | 5/1990 |
| JP | 04501221 | A | 3/1992 |
| JP | H08158201 | A | 6/1996 |
| JP | H08209486 | A | 8/1996 |
| JP | H08-260286 | A | 10/1996 |
| JP | 2703390 | B2 | 1/1998 |
| JP | 1088448 | A | 4/1998 |
| JP | 10280230 | A | 10/1998 |
| JP | 2000-303257 | A | 10/2000 |
| JP | 2000-328363 | A | 11/2000 |
| JP | 2001-234066 | A | 8/2001 |
| JP | 2003-105659 | A | 4/2003 |
| JP | 2005-532484 | A | 10/2005 |
| JP | 2007-500802 | A | 1/2007 |
| JP | 2007-500803 | A | 1/2007 |
| JP | 2007-507595 | A | 3/2007 |
| JP | 2008-031618 | A | 2/2008 |
| JP | 2008208509 | A | 9/2008 |
| JP | 2011502218 | A | 1/2011 |
| JP | 5090778 | B2 | 9/2012 |
| JP | 2013-542334 | A | 11/2013 |
| JP | 5887366 | B2 | 2/2016 |
| JP | 5887376 | B2 | 2/2016 |
| KR | 930009831 | | 10/1993 |
| KR | 1020060122840 | A | 11/2006 |
| KR | 1020070012391 | A | 1/2007 |
| RU | 2402648 | C1 | 10/2010 |
| TW | 200538499 | A | 12/2005 |
| TW | 200613448 | A | 5/2006 |
| TW | 200617097 | A | 6/2006 |
| WO | 93/24690 | A1 | 12/1993 |
| WO | 0000686 | A1 | 1/2000 |
| WO | 0220887 | A2 | 3/2002 |

(56) References Cited

FOREIGN PATENT DOCUMENTS

| | | | |
|---|---|---|---|
| WO | 02052077 | A2 | 7/2002 |
| WO | 2004/005606 | A1 | 1/2004 |
| WO | 2004002254 | A1 | 1/2004 |
| WO | 2004088023 | | 10/2004 |
| WO | 2005/033192 | A1 | 4/2005 |
| WO | 2005/090660 | A1 | 9/2005 |
| WO | 2005/095685 | A1 | 10/2005 |
| WO | 2005092132 | A1 | 10/2005 |
| WO | 2006008900 | A1 | 1/2006 |
| WO | 2006017709 | | 2/2006 |
| WO | 2006034131 | A2 | 3/2006 |
| WO | 2006043958 | A1 | 4/2006 |
| WO | 2006049626 | A1 | 5/2006 |
| WO | 2006101933 | A2 | 9/2006 |
| WO | 2007061423 | A2 | 5/2007 |
| WO | 2007070079 | A1 | 6/2007 |
| WO | 2007133177 | A2 | 11/2007 |
| WO | 2008/027454 | A1 | 3/2008 |
| WO | 2008048308 | A2 | 4/2008 |
| WO | 2009/101930 | A1 | 8/2009 |
| WO | 2010091476 | A1 | 8/2010 |
| WO | 2010/135423 | A1 | 11/2010 |
| WO | 2011/056467 | A2 | 5/2011 |
| WO | 2012/040332 | A2 | 3/2012 |
| WO | 2012/077681 | A1 | 6/2012 |
| WO | 2012/121759 | A2 | 9/2012 |
| WO | 2013/074181 | A2 | 5/2013 |
| WO | 2016/010659 | A1 | 1/2016 |
| WO | 2016/033593 | A1 | 3/2016 |
| WO | 2017/070529 | A1 | 4/2017 |

OTHER PUBLICATIONS

"Fabric Flame Retardant Treatment "Precondensate"/NH3 Process", Technical Bulletin, Cotton Incorporated, TRI 4002, 2003, 12 pages.

"GlenGuard™ FR", Glen Raven Technical Fabrics, LLC, 4 pages.

"Pigments as Colorants: Pigmenting or Pigmentation", Textile Dyeing and Coloration, Chapter 23, 1997, 12 pages.

"Polyesters and Polyamides", Conclusions and future Trends, Woodhead Publishing Limited, Woodhead Publishing in Textiles, No. 71, 2008, p. 320.

Horrocks et al., "Fabric Flame Retardant Treatment", Fire Retardant Materials, vol. 148, 2003, 12 pages.

Mathur et al., "Color and Weave Relationship in Woven Fabrics", Advances in Modern Woven Fabrics Technology, IntechOpen, Jul. 27, 2011, 24 pages.

Yang et al., "A Durable Flame Retardant for Cellulosic Fabrics", Polymer degradation and stability, vol. 97, No. 11, Nov. 1, 2012, pp. 2467-2472.

"Introducing Our Lightest Dual Hazard Fabric Ever", DRIFIRE, Product Line, 2015, 3 pages.

"Ready for Action", Lion, Dec. 21, 2011, 60 pages.

"Tools & Technologies: Fire Service Prepares for Change in PPE Technology", Trade Journal, Firehouse, vol. 37, Feb. 1, 2012, 3 pages.

U.S. Appl. No. 16/832,991 , Final Office Action, dated Jul. 27, 2021, 13 pages.

U.S. Appl. No. 16/832,991, Non-Final Office Action, dated Feb. 26, 2021, 8 pages.

PCT Patent Application No. PCT/US2020/025434, International Preliminary Report on Patentability, dated Oct. 7, 2021, 10 pages.

Smith , "Lyocell—One Fiber, Many Faces", Ohio State University, Available Online at: http://web.archive.org/web/20060830212533/http://ohioline.osu.edu/hyg-fact/5000/5572.html, Aug. 30, 2016, pp. 1-5.

Australian Patent Application No. 2020245599, First Examination Report, dated Nov. 18, 2021, 4 pages.

Canadian Patent Application No. 3,135,175, Office Action, dated Nov. 22, 2021, 4 pages.

New Zealand Patent Application No. 781462, First Examination Report, dated Nov. 17, 2021, 1 page.

* cited by examiner

FLAME RESISTANT FABRICS

CROSS-REFERENCE TO RELATED APPLICATIONS

This application is a divisional of U.S. patent application Ser. No. 16/832,991, filed Mar. 27, 2020 and entitled "Flame Resistant Fabrics", which claims the benefit of U.S. Provisional Application No. 62/825,350, filed Mar. 28, 2019 and entitled "Low Cost Flame Resistant Fabrics with Inherently Flame Resistant Fibers," the entirety of all which are hereby incorporated by reference.

FIELD OF THE INVENTION

Embodiments of the present invention relates to low cost and low weight flame resistant protective fabrics and garments made therefrom that impart improved protection to the wearer.

BACKGROUND

Many occupations can potentially expose an individual to electrical arc flash and/or flames. Workers who may be exposed to accidental electric arc flash and/or flames risk serious burn injury unless they are properly protected. To avoid being injured while working in such conditions, these individuals typically wear protective garments constructed of flame resistant materials designed to protect them from electrical arc flash and/or flames. Such protective clothing can include various garments, for example, coveralls, pants, and shirts. Standards have been promulgated that govern the performance of such garments (or constituent layers or parts of such garments) to ensure that the garments sufficiently protect the wearer in hazardous situations. Fabrics from which such garments are constructed, and consequently the resulting garments as well, are required to pass a variety of safety and/or performance standards, including ASTM F1506, NFPA 70E, NFPA 2112, and NFPA 1975.

ASTM F1506 (Standard Performance Specification for Flame Resistant and Arc Rated Textile Materials for Wearing Apparel for Use by Electrical Workers Exposed to Momentary Electric Arc and Related Thermal Hazards, 2018 edition, incorporated herein by reference) requires arc rating testing of protective fabrics worn by electrical workers. The arc rating value represents a fabric's performance when exposed to an electrical arc discharge. The arc rating is expressed in cal/cm$^2$ (calories per square centimeter) and is derived from the determined value of the arc thermal performance value (ATPV) or Energy Breakopen threshold ($E_{BT}$). ATPV is defined as the arc incident energy on a material that results in a 50% probability that sufficient heat transfer through the specimen is predicted to cause the onset of second-degree burn injury based on the Stoll Curve. $E_{BT}$ is the arc incident energy on a material that results in a 50% probability of breakopen. Breakopen is defined as any open area in the material at least 1.6 cm$^2$ (0.5 in.$^2$). The arc rating of a material is reported as either ATPV or $E_{BT}$, whichever is the lower value. The ATPV and $E_{BT}$ is determined pursuant to the testing methodology set forth in ASTM F1959 (Standard Test Method for Determining the Arc Rating of Materials for Clothing, 2014 edition, incorporated herein by reference), where sensors measure thermal energy properties of protective fabric specimens during exposure to a series of electric arcs.

NFPA 70E (Standard for Electrical Safety in the Workplace, 2018 edition, incorporated herein by reference) offers a method to match protective clothing to potential exposure levels incorporating Personal Protective Equipment (PPE) Categories. Protective fabrics are tested to determine their arc rating, and the measured arc rating determines the PPE Category for a fabric as follows:

PPE Category and ATPV
PPE Category 1: ATPV/$E_{BT}$: 4 cal/cm$^2$
PPE Category 2: ATPV/$E_{BT}$: 8 cal/cm$^2$
PPE Category 3: ATPV/$E_{BT}$: 25 cal/cm$^2$
PPE Category 4: ATPV/$E_{BT}$: 40 cal/cm$^2$ Thus, NFPA 70E dictates the level of protection a fabric must possess to be worn by workers in certain environments.

NFPA 2112 (Standard on Flame-Resistant Clothing for Protection of Industrial Personnel Against Flash Fire, 2018 edition, incorporated herein by reference) governs the required performance of industrial worker garments that protect against flash fires. NFPA 1975 (Standard on Emergency Services Work Apparel, 2014 edition, incorporated herein by reference) governs the required performance of station wear worn by firefighter's in the firehouse and under turnout gear. NFPA 2112, ASTM F1506, and NFPA 1975 all require that the garments and/or individual layers or parts thereof pass a number of different performance tests, including compliance with the thermal protective requirements of having a char length of 4 inches or less (NFPA 2112) or 6 inches or less (ASTM F1506 and NFPA 1975) and of having a two second (or less) afterflame (NFPA 2112, ASTM F1506, and NFPA 1975), when measured pursuant to the testing methodology set forth in ASTM D6413 (Standard Test Method for Flame Resistance of Textiles, 2015 edition, incorporated herein by reference).

To test for char length and afterflame, a fabric specimen is suspended vertically over a flame for twelve seconds. The fabric must self-extinguish within two seconds (i.e., it must have a 2 second or less afterflame). After the fabric self-extinguishes, a specified amount of weight is attached to the fabric and the fabric lifted so that the weight is suspended from the fabric. The fabric will typically tear along the charred portion of the fabric. The length of the tear (i.e., the char length) must be 4 inches or less (ASTM 2112) or 6 inches or less (ASTM F1506 and NFPA 1975) when the test is performed in both the machine/warp and cross-machine/weft directions of the fabric. A fabric sample is typically tested for compliance both before it has been washed (and thus when the fabric still contains residual—and often flammable—chemicals from finishing processes) and after a certain number of launderings (e.g., 100 launderings for NFPA 2112 and 25 launderings for ASTM F1506).

NFPA 2112 and NFPA 1975 also contain requirements relating to the extent to which the fabric shrinks when subjected to heat. To conduct thermal shrinkage testing, marks are made on the fabric a distance from each other in both the machine/warp and cross-machine/weft directions. The distance between sets of marks is noted. The fabric is then suspended in a 500 degree Fahrenheit oven for 5 minutes. The distance between sets of marks is then remeasured. The thermal shrinkage of the fabric is then calculated as the percentage that the fabric shrinks in both the machine/warp and cross-machine/weft directions and must be less than the percentage set forth in the applicable standard. For example, NFPA 2112 and NFPA 1975 require that fabrics used in the construction of flame resistant garments exhibit thermal shrinkage of no more than 10% in both the machine/warp and cross-machine/weft directions.

NFPA 1975 further contains a thermal stability standard. To test for thermal stability, a fabric sample is folded and inserted between two glass plates. The sandwich is then put in an oven at a specified temperature and for a specified time. After heating, the fabric is pulled apart. If the fabric sticks to itself, it fails the thermal stability test.

In the oil, gas, electric utility, and fire safety markets, there is a need for inexpensive, lightweight flame resistant fabrics that achieve a high arc rating while still complying with all applicable thermal protective requirements. More specifically, there is a need for inexpensive, lighter weight protective fabrics that achieve NFPA 70E PPE Category 2 protection (8 cal/cm$^2$ arc rating). Due to high temperature working conditions in some workplaces, end users also have a need for comfortable (e.g., breathable) protective fabrics that have excellent moisture management properties (e.g., wicking).

Historically, such fabrics have been formed from identical yarns made exclusively from cellulosic fibers treated with a chemical (e.g., phosphorous) to render them flame resistant. Cellulosic fibers are cheap, lightweight, and soft, thus rendering the fabrics into which they are incorporated inexpensive and comfortable. However, the flame resistance of these fibers is not inherent to the fibers themselves. Rather, the fibers must be chemically-treated to impart flame resistance to them. If the fibers are not treated properly, the chemicals can wash out of the fibers and thereby significantly diminish the flame resistant properties of the fibers and thus the fabrics and garments into which they are incorporated. Existing fabrics formed with inherently flame resistant fibers that do not suffer from this same drawback are more expensive and harsher to the touch. Thus, such fabrics have been unable to compete successfully in this space. There is a need for a comfortable, lightweight, inexpensive fabric formed with inherently flame resistant fibers that affords the requisite thermal and arc protection.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the present invention relate to flame resistant fabrics formed with inherently flame resistant fibers that provide the requisite thermal and arc protection but that are less expensive than other fabrics formed with inherently flame resistant fibers and that have improved comfort. Improved comfort and lower cost can be achieved by predominantly locating the inherently flame resistant fibers on the front face of the fabric to impart the requisite thermal and arc protection and predominantly locating the more comfortable (and less expensive) fibers on the back face of the fabric positioned next to the wearer. In this way, overall protection of the fabric is maintained while improving comfort. Some embodiments of such fabrics may also achieve NFPA 70E PPE Category 2 protection (≥8 cal/cm$^2$ arc rating whether ATPV or EBT). Moreover, in some embodiments the flame resistant fabrics contain fibers having at least one energy absorbing and/or reflecting additive incorporated into the fibers. Inclusion of such fibers into the fabric increases the arc protection of the fabric while still complying with all requisite thermal protective requirements.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Some embodiments of the fabrics described herein have anisotropic properties in that the fabrics are constructed such that the body side of the fabric (the side of the fabric proximate the wearer (assuming the fabric will be incorporated into a garment)) and the face side of the fabric (the side of the fabric facing away from the wearer) have different properties. More specifically, in some embodiments a higher percentage of inherently flame resistant fibers (or yarns containing the fibers) are located and exposed on the face side of the fabric (as opposed to on the body side of the fabric). In such embodiments, a higher percentage of less expensive and more comfortable fibers (or yarns containing the fibers) are located and exposed on the body side of the fabric (as opposed to on the face side of the fabric). In such embodiments, the face side of the fabric thus effectively imparts the requisite thermal and arc protection and the body side of the fabric provides superior comfort and/or lower cost in relation to the face side of the fabric.

Fabrics according to such embodiments can be formed pursuant to any method that results in the fabric having different properties on the body side and the face side of the fabric. In some embodiments, the fabrics are a woven, knitted, and/or nonwoven fabric.

Woven and/or knitted fabrics may be formed to have anisotropic properties through the use of at least a first group of yarns and a second group of yarns, whereby each yarn group has a different fiber blend. The different fiber blends can be attributable to the two yarn groups having different amounts of the same fibers or to the two yarn groups having different fibers or different blends of fibers. In addition, it will be recognized that in some embodiments the yarns need not be blended at all. In other words, some yarns could be 100% of a single fiber type. Regardless, the first group of yarns is predominantly exposed on the face side of the fabric and the second group of yarns is predominantly exposed on the body side of the fabric. In some embodiments, the fabric is formed only of the first group of yarns and the second group of yarns (i.e., these two yarn types form the entirety of the fabric). In other embodiments, yarns in addition to the first and second groups of yarns may be incorporated into the fabric.

Fabrics of the invention may be formed with spun yarns, filament yarns, stretch broken yarns, or combinations thereof. The yarns can comprise a single yarn or two or more individual yarns that are combined together in some form, including, but not limited to, twisting, plying, tacking, wrapping, covering, core-spinning (i.e., a filament or spun core at least partially surrounded by spun fibers or yarns), etc.

In some embodiments, the yarns of the first group of yarns ("first yarns") are spun yarns having a fiber blend that includes inherently flame resistant fibers. In some embodiments, the first yarns include at least 50% inherently flame resistant fibers, at least 55% inherently flame resistant fibers, at least 60% inherently flame resistant fibers, at least 65% inherently flame resistant fibers, at least 70% inherently flame resistant fibers, at least 75% inherently flame resistant fibers, at least 80% inherently flame resistant fibers, at least 85% inherently flame resistant fibers, and/or at least 90% inherently flame resistant fibers. Examples of suitable inherently flame resistant fibers include, but are not limited to, para-aramid fibers, meta-aramid fibers, polybenzoxazole ("PBO") fibers, polybenzimidazole ("PBI") fibers, modacrylic fibers, poly{2,6-diimidazo[4,5-b:40; 50-e]-pyridinylene-1,4(2,5-dihydroxy)phenylene} ("PIPD") fibers, polyacrylonitrile (PAN) fibers, liquid crystal polymer fibers, glass fibers, carbon fibers, TANLON™ fibers (available from Shanghai Tanlon Fiber Company), wool fibers, melamine fibers (such as BASOFIL™, available from Basofil Fibers), polyetherimide fibers, pre-oxidized acrylic fibers, polyamide-imide fibers such as KERMEL™, polytetrafluoroethylene fibers, polyetherimide fibers, polyimide fibers, and polyimide-amide fibers and any combination or blend thereof. Examples of para-aramid fibers include KEVLAR™ (available from DuPont), TECHNORA™ (available from Teijin Twaron BV of Arnheim, Netherlands), and TWARON™ (also available from Teijin Twaron By), and Taekwang para-aramid (available from Taekwang Industries). Examples of meta-aramid fibers include NOMEX™ (available from DuPont), CONEX™ (available from Teijin), APYEIL™ (available from Unitika), ARAWIN (available from Toray). An example of suitable modacrylic fibers are PROTEX™ fibers available from Kaneka Corporation of Osaka, Japan, SEF™ available from Solutia, or blends thereof.

The same inherently flame resistant fibers may be used in the first yarns, but such is not a requirement. Rather, the fiber blend of the first yarns may include the same type of inherently flame resistant fibers or, alternatively, different types of inherently flame resistant fibers may be provided in the blend.

In some embodiments, the inherently flame resistant fibers in the first yarns include a blend of aramid fibers (meta-aramid, para-aramid, or both) and modacrylic fibers. The modacrylic fibers are significantly less expensive than the aramid fibers, thus helping to contain the cost of the fabric. Moreover, in some embodiments the percentage of modacrylic fibers in the fiber blend of the first yarns is up to 2 times, up to 3 times, up to 4 times, up to 5 times, up to 6 times, up to 7 times, and/or up to 8 times the percentage of aramid fibers in the blend. In some embodiments, the first yarns include at least 40% modacrylic fibers, at least 45% modacrylic fibers, at least 50% modacrylic fibers, at least 55% modacrylic fibers, at least 60% modacrylic fibers, at least 65% modacrylic fibers, at least 70% modacrylic fibers, at least 75% modacrylic fibers, and/or at least 80% modacrylic fibers. In some embodiments, the first yarns include approximately (i) 40-90% modacrylic fibers, inclusive; (ii) 45-85% modacrylic fibers, inclusive; (iii) 50-80% modacrylic fibers, inclusive; (iv) 50-70% modacrylic fibers, inclusive; (v) 55-65% modacrylic fibers, inclusive; (vi) 60-80% modacrylic fibers, inclusive; and/or (vii) 65-75% modacrylic fibers, inclusive. In some embodiments, the first yarns include at least 5% aramid fibers, at least 10% aramid fibers, at least 15% aramid fibers, at least 20% aramid fibers, at least 25% aramid fibers, at least 30% aramid fibers, and/or at least 35% aramid fibers. In some embodiments, the first yarns include approximately (i) 5-35% aramid fibers, inclusive; (ii) 10-30% aramid fibers, inclusive; (iii) 15-25% aramid fibers, inclusive; (iv) 10-20% aramid fibers, inclusive; (v) 10-15% aramid fibers, inclusive; and/or (vi) 15-20% aramid fibers, inclusive.

In some embodiments, the first yarns include approximately (i) 5-35% aramid fibers and 40-90% modacrylic fibers, inclusive; (ii) 5-25% aramid fibers and 50-80% modacrylic fibers, inclusive; (iii) 10-20% aramid fibers and 50-80% modacrylic fibers, inclusive; (iv) 10-20% aramid fibers and 50-70% modacrylic fibers, inclusive; (v) 10-20% aramid fibers and 50-60% modacrylic fibers, inclusive; (vi) 15-25% aramid fibers and 60-80% modacrylic fibers, inclusive; (vii) 15-25% aramid fibers and 65-75% modacrylic fibers, inclusive; (viii) 18-23% aramid fibers and 65-75% modacrylic fibers, inclusive; (ix) 10-15% aramid fibers and 50-65% modacrylic fibers, inclusive; and/or (x) 10-15% aramid fibers and 50-60% modacrylic fibers, inclusive.

In some embodiments, cellulosic fibers may be added to the fiber blend of the first yarns to reduce cost and impart comfort. In some embodiments, the first yarns include at least 5% cellulosic fibers, at least 10% cellulosic fibers, at least 15% cellulosic fibers, at least 20% cellulosic fibers, at least 25% cellulosic fibers, at least 30% cellulosic fibers, at least 35% cellulosic fibers, at least 40% cellulosic fibers, at least 45% cellulosic fibers, or at least 50% cellulosic fibers. In some embodiments, the first yarns include approximately (i) 5-50% cellulosic fibers, inclusive; (ii) 10-35% cellulosic fibers, inclusive; (iii) 5-25% cellulosic fibers, inclusive; (iv) 5-20% cellulosic fibers, inclusive; (v) 5-15% cellulosic fibers, inclusive; (vi) 10-20% cellulosic fibers, inclusive; (vii) 10-15% cellulosic fibers, inclusive; (viii) 20-40% cellulosic fibers, inclusive; and/or (ix) 25-35% cellulosic fibers, inclusive.

In some embodiments, the cellulosic fibers are lyocell fibers and/or non-FR lyocell fibers. In some embodiments, blends of different cellulosic fibers are used in the fiber blend of the first yarns. While the cellulosic fibers can be treated so as to be flame resistant, this is not necessary. Rather, inclusion of the inherently flame resistant fibers in the fiber blend imparts sufficient flame resistance and arc protection and prevents the cellulosic fibers from burning. For example, the modacrylic fibers control and counteract the flammability of the cellulosic fibers to prevent the cellulosic fibers from burning. In this way, the cellulosic fibers (or the yarns or fabrics made with such fibers) need not be treated with a FR compound or additive.

In some embodiments, the first yarns include approximately (i) 5-35% aramid fibers, 40-90% modacrylic fibers, and 5-50% cellulosic fibers (FR and/or non-FR), inclusive; (ii) 5-30% aramid fibers, 50-80% modacrylic fibers, and 10-40% cellulosic fibers (FR and/or non-FR), inclusive; (iii) 5-25% aramid fibers, 50-80% modacrylic fibers, and 15-40% cellulosic fibers (FR and/or non-FR), inclusive; (iv) 10-20% aramid fibers, 50-70% modacrylic fibers, and 20-45% cellulosic fibers (FR and/or non-FR), inclusive; (v) 10-20% aramid fibers, 50-70% modacrylic fibers, and 20-40% cellulosic fibers (FR and/or non-FR), inclusive; (vi) 10-15% aramid fibers, 55-70% modacrylic fibers, and 25-40% cellulosic fibers (FR and/or non-FR), inclusive; (vii) 10-30% aramid fibers, 60-80% modacrylic fibers, and 5-20% cellulosic fibers (FR and/or non-FR), inclusive; and/ or (viii) 15-25% aramid fibers, 65-75% modacrylic fibers, and 5-15% cellulosic fibers (FR and/or non-FR), inclusive.

In some embodiments, the yarns of the second group of yarns ("second yarns") are spun yarns having a fiber blend that includes more fibers that are more comfortable and less expensive than fibers in the first yarns. Such fibers include, but are not limited to, natural and synthetic cellulosic fibers (e.g., cotton, rayon, acetate, triacetate, and lyocell, as well as their flame resistant counterparts FR cotton, FR rayon, FR acetate, FR triacetate, and FR lyocell), modacrylic fibers, wool, TANLON™ fibers (available from Shanghai Tanlon Fiber Company), nylon fibers, polyester fibers, etc., and blends thereof. An example of FR rayon fibers is Lenzing FR™ fibers, also available from Lenzing Fibers Corporation, and VISIL™ fibers, available from Sateri. Examples of lyocell fibers include TENCEL™, TENCEL G100™ and TENCEL A100™ fibers, all available from Lenzing Fibers Corporation. An example of a polyester fiber is DACRON® fibers (available from Invista™). Examples of suitable modacrylic fibers are PROTEX™ fibers available from Kaneka Corporation of Osaka, Japan, SEF™ fibers available from Solutia, PyroTex® fibers available from PyroTex Fibers GmbH, or blends thereof.

The second yarns preferably include cellulosic fibers for comfort, which can be FR and/or non-FR. In some embodiments, the cellulosic fibers are lyocell fibers and/or non-FR lyocell fibers. In some embodiments, the second yarns include at least 10% cellulosic fibers, at least 20% cellulosic fibers, at least 30% cellulosic fibers, at least 40% cellulosic fibers, at least 50% cellulosic fibers, at least 60% cellulosic fibers, at least 70% cellulosic fibers, at least 80% cellulosic fibers, or at least 90% cellulosic fibers. In some embodiments, the second yarns include approximately (i) 50-90% cellulosic fibers, inclusive; (ii) 55-85% cellulosic fibers, inclusive; (iii) 60-85% cellulosic fibers, inclusive; (iv) 65-85% cellulosic fibers, inclusive; (v) 70-85% cellulosic fibers, inclusive; (vi) 70-80% cellulosic fibers, inclusive; (vii) 60-75% cellulosic fibers, inclusive; and/or (viii) 65-75% cellulosic fibers, inclusive.

In some embodiments, the second yarns include a blend of cellulosic fibers and inherently flame resistant fibers (such as aramid fibers), which enhance thermal and arc protection and which help to resist thermal shrinkage. If inherently flame resistant fibers are included in the fiber blend of the second yarns, the percentage of such fibers are preferably (but do not have to be) less than the percentage of inherently flame resistant fibers used in the fiber blend of the first yarns. In some embodiments, inherently flame resistant fibers constitute 50% or less, 40% or less, 30% or less, or 20% or less of the fiber blend of the second yarns. In some embodiments, the second yarns include at least 10% inherently flame resistant fibers, at least 15% inherently flame resistant fibers, at least 20% inherently flame resistant fibers, at least 25% inherently flame resistant fibers, at least 30% inherently flame resistant fibers, at least 35% inherently flame resistant fibers, and/or at least 40% inherently flame resistant fibers. In some embodiments, the second yarns include approximately (i) 10-50% inherently flame resistant fibers, inclusive; (ii) 10-40% inherently flame resistant fibers, inclusive; (iii) 10-35% inherently flame resistant fibers, inclusive; (iv) 10-30% inherently flame resistant fibers, inclusive; (v) 15-25% inherently flame resistant fibers, inclusive; and/or (vi) 20-30% inherently flame resistant fibers, inclusive.

In some embodiments, the second group of yarns includes approximately (i) 50-90% cellulosic fibers and 10-50% inherently flame resistant fibers, inclusive; (ii) 60-90% cellulosic fibers and 10-40% inherently flame resistant fibers, inclusive; (iii) 65-85% cellulosic fibers and 10-35% inherently flame resistant fibers, inclusive; (iv) 65-80% cellulosic fibers and 10-30% inherently flame resistant fibers, inclusive; (v) 70-80% cellulosic fibers and 20-30% inherently flame resistant fibers, inclusive; and/or (vi) 65-75% cellulosic fibers and 15-25% inherently flame resistant fibers, inclusive.

In some embodiments, different cellulosic fibers (e.g., blends of lyocell and rayon, blends of FR and non-FR cellulosic fibers, etc.) and/or inherently flame resistant fibers (e.g., para-aramid, meta-aramid, and/or modacrylic, etc.) are used in the fiber blend of the second yarns. In some embodiments, the inherently flame resistant fibers used in the fiber blend of the second yarns are modacrylic fibers and/or aramid fibers, such as para-aramid fibers, meta-aramid fibers, or blends thereof. In some embodiments, the modacrylic fibers constitute a greater percentage of the fiber blend of the second yarns than the aramid fibers. In some embodiments, the modacrylic fibers constitute 0-30% and the aramid fibers constitute 1-30% of the fiber blend of the second yarns. In some embodiments, the modacrylic fibers constitute 0-25% and the aramid fibers constitute 1-25% of the fiber blend of the second yarns. In some embodiments, the modacrylic fibers constitute 5-20% and the aramid fibers constitute 1-15% of the fiber blend of the second yarns. In some embodiments, the modacrylic fibers constitute 10-20% and the aramid fibers constitute 1-5% of the fiber blend of the second yarns. In some embodiments, the modacrylic fibers constitute 15-20% and the aramid fibers constitute 1-5% of the fiber blend of the second yarns.

In some embodiments, the second yarns include approximately (i) 1-20% aramid fibers, 5-40% modacrylic fibers, and 50-90% cellulosic fibers (FR and/or non-FR), inclusive; (ii) 1-15% aramid fibers, 10-35% modacrylic fibers, and 65-90% cellulosic fibers (FR and/or non-FR), inclusive; (iii) 1-10% aramid fibers, 10-25% modacrylic fibers, and 70-90% cellulosic fibers (FR and/or non-FR), inclusive; (iv) 1-5% aramid fibers, 10-20% modacrylic fibers, and 75-85% cellulosic fibers (FR and/or non-FR), inclusive; and/or (v) 1-5% aramid fibers, 15-20% modacrylic fibers, and 75-85% cellulosic fibers (FR and/or non-FR), inclusive.

In some embodiments, the fiber blend of the second yarns is devoid of modacrylic fibers. In some embodiments, aramid fibers are the only inherently flame resistant fibers provided in the second yarns. In such embodiments, the second yarns can include approximately (i) 5-50% aramid fibers, inclusive; (ii) 10-45% aramid fibers, inclusive; (iii) 10-40% aramid fibers, inclusive; (iv) 15-35% aramid fibers, inclusive; (v) 20-35% aramid fibers, inclusive; and/or (vi) 25-35% aramid fibers, inclusive.

In such embodiments, the second yarns include approximately (i) 50-90% cellulosic fibers and 10-50% aramid fibers, inclusive; (ii) 60-80% cellulosic fibers and 20-40% aramid fibers, inclusive; (iii) 65-80% cellulosic fibers and 25-35% aramid fibers, inclusive; and/or (iv) 65-75% cellulosic fibers and 25-35% aramid fibers, inclusive.

In some embodiments, the fiber blend of the overall fabric includes approximately (i) 25-65% cellulosic fibers (e.g., lyocell fibers and/or non-FR lyocell fibers), 25-65% modacrylic fibers, and 5-25% aramid fibers, inclusive; (ii) 30-60% cellulosic fibers (e.g., lyocell fibers and/or non-FR lyocell fibers), 25-60% modacrylic fibers, and 5-20% aramid fibers, inclusive; (iii) 35-60% cellulosic fibers (e.g., lyocell fibers and/or non-FR lyocell fibers), 30-55% modacrylic fibers, and 5-15% aramid fibers, inclusive; (iv) 40-60% cellulosic fibers (e.g., lyocell fibers and/or non-FR lyocell fibers), 30-50% modacrylic fibers, and 5-15% aramid fibers, inclusive; (v) 40-55% cellulosic fibers (e.g., lyocell fibers and/or non-FR lyocell fibers), 30-50% modacrylic fibers, and 5-15% aramid fibers, inclusive; (vi) 45-55% cellulosic fibers (e.g., lyocell fibers and/or non-FR lyocell fibers), 35-45% modacrylic fibers, and 5-15% aramid fibers, inclusive; (vii) 25-50% cellulosic fibers (e.g., lyocell fibers and/or non-FR lyocell fibers), 25-50% modacrylic fibers, and 10-40% aramid fibers, inclusive; (viii) 30-45% cellulosic fibers (e.g., lyocell fibers and/or non-FR lyocell fibers), 30-45% modacrylic fibers, and 15-30% aramid fibers, inclusive; and/or (ix) 30-40% cellulosic fibers (e.g., lyocell fibers and/or non-FR lyocell fibers), 35-45% modacrylic fibers, and 20-30% aramid fibers, inclusive.

It may be beneficial, but not required, to include nylon fibers in either or both of the first yarns and the second yarns as nylon fibers impart abrasion resistance and thus enhance the durability and wear properties of the fabric made with such yarns.

It has also been discovered that incorporating into the fabric (via the first yarns, second yarns, or otherwise) fibers having at least one energy absorbing and/or reflecting additive increases the arc rating of the fabric while still complying with all requisite thermal protective requirements.

It is believed that such energy (e.g., radiation) absorbing and/or reflecting additives serve to prevent heat energy transmission through the fabric and to the wearer's skin by absorbing the energy and/or reflecting the energy away from the fabric such that it does not reach the wearer. Additive-containing fibers ("AC fibers") are fibers whereby an energy absorbing and/or reflecting additive is introduced during the process of manufacturing the fibers themselves and not after fiber formation. This is in contrast to a finish applied onto the fabric surface whereby a binder typically must be used to fix the additive onto the fabric. In these cases, the additive is apt to wash and/or wear/abrade off the fabric during laundering. Provision of the additive in the fibers during fiber formation results in better durability as the additive is trapped within the fiber structure. Examples of AC fibers are identified and described in U.S. Patent Publication No. 2017/0370032 to Stanhope et al., U.S. Patent Publication No. 2017/0295875 to Ohzeki et al., and U.S. patent Ser. No. 16/271,162 to Stanhope et al., the entirety of each of which is herein incorporated by reference. Note that while AC fibers may be used in embodiments of the fabrics contemplated herein, they need not always be used. For example, some AC fibers are producer-colored fibers. In producer coloring (also known as "solution dyeing"), pigment is injected into the polymer solution prior to forming the fibers. Thus, "producer-colored" fibers refers to fibers that are colored during the process of manufacturing the fibers themselves and not after fiber formation. If darker-colored additives (such as navy and black) are used to color the fibers, use of such darker fibers (such as producer-colored aramid fibers) in fabrics may render the fabrics more difficult to dye to lighter shades of color. Thus, it might not always be desirable to use AC aramid fibers in the blends disclosed herein, particularly if such AC aramid fibers are darker shades.

If AC fibers are desired, the AC fibers may be incorporated into either or both of the first and second yarns. In some embodiments, the AC fibers are incorporated into the first yarns so as to be exposed on the face side of the fabric. For example, in some embodiments the AC fibers are modacrylic fibers that include an infrared absorber, such as described in U.S. Patent Publication No. 2017/0295875 to Ohzeki et al. and/or sold as PROTEX™ A fibers by Kaneka Corporation of Osaka, Japan (as opposed to PROTEX™ C fibers which do not contain such an additive).

In some embodiments, the AC fibers are incorporated into the fiber blend of the first yarns to enhance the arc protection on the face of the fabric. In some embodiments, the AC fibers are only incorporated into the fiber blend of the first yarns and are not incorporated into the second yarns. In some embodiments, the modacrylic fibers in the first yarns are AC fibers, such as, but not limited to, PROTEX™ A fibers.

The AC fibers provided in the fabric need not all be the same. For example, the fiber blend may include the same type of AC fiber or, alternatively, different types of AC fibers may be provided in the blend.

In some embodiments, the AC fibers (such as the AC version of any of the fibers identified above) constitute 20-60%, inclusive, of the fiber blend of the fabric; 20-50%, inclusive, of the fiber blend of the fabric; 25-50%, inclusive, of the fiber blend of the fabric; 25-45%, inclusive, of the fiber blend of the fabric; 30-45%, inclusive, of the fiber blend of the fabric; or 35-45%, inclusive, of the fiber blend of the fabric. In some embodiments, the AC fibers constitute at least 5% or at least 10% or at least 15% or at least 20% or at least 25% or at least 30% or at least 35% or at least 40% or at least 45% and (i) no more than 60%, (ii) no more than 50%, (iii) no more than 45%, (iv) no more than 40%, or (v) no more than 35%, inclusive, of the fiber blend of the fabric.

In some embodiments, the fabrics are woven fabrics formed of the first yarns and the second yarns. In some embodiments, only the first yarns will be oriented in the warp direction and only the second yarns will be oriented in the fill direction. In this way, the fibers on the face side of the fabric will predominantly comprise those of the first yarns and the fibers on the body side of the fabric will predominantly comprise those of the second yarns.

In other embodiments, not all of the warp or fill yarns are the same. For example, the first and second yarns may be provided in both the warp and fill directions by providing the first yarns on some ends and picks and the second yarns on other ends and picks (in any sort of random arrangement or alternating pattern). Or all of the yarns in one of the warp or fill direction could be identical (e.g., either all first yarns or all second yarns) and different yarns (both first and second yarns) used only in the other of the warp or fill direction.

The fabric may be constructed with the first and second yarns in a variety of ways, including but not limited to, one or more of twill weave (2×1, 3×1, etc.), twill weave containing a rip-stop pattern, satin weave (4×1, 5×1, etc.), sateen weave, and double-cloth constructions, or any other weave where yarn is predominantly more on one side of the fabric than the other side of the fabric. A person skilled in the art would be familiar with and could utilize suitable fabric constructions.

It will also be recognized that any woven fabric will have both warp and fill yarns visible on each side of the fabric. Fabrics woven in accordance with some embodiments of the present invention, however, are woven such that more of the first yarns are located on the face side of the fabric, and thus more of the second yarns are located on the body side of the fabric. Thus, in an exemplary fabric construction in which more of the first yarns are located or exposed on the face side of the fabric and more of the second yarns are located or exposed on the body side of the fabric, the first yarns are "predominantly" exposed on the face side of the fabric (even though some of the first yarns would be visible from the body side of the fabric) and the second yarns are "predominantly" exposed on the body side of the fabric (even though some of the second yarns would be visible from the face side of the fabric).

In other embodiments of the invention, a knit fabric that has different properties on each side of the fabric can be constructed. Such a fabric could be constructed using double-knit technology such that the first yarns will be predominantly exposed on the face side of the fabric and the second yarns will be predominantly exposed on the opposing body side of the fabric.

Embodiments of the fabric can be of any weight, but in some embodiments are between 5 to 7 ounces per square yard (osy), inclusive. In some embodiments, the fabric weight is at least 5 osy but less than or equal to 7 osy, 6.9 osy, 6.8 osy, 6.7 osy, 6.6 osy, 6.5 osy, 6.4 osy, 6.3 osy, 6.2 osy, 6.1 osy, 6.0 osy, 5.9 osy, 5.8 osy, 5.7 osy, 5.6 osy, 5.5 osy, 5.4 osy, 5.3 osy, 5.2 osy, and/or 5.1 osy.

Fabrics according to some embodiments of the present invention strategically place fibers useful for thermal and arc protection (e.g., aramid fibers which tend to be more expensive and less comfortable) on the face side of the fabric and more comfortable, less expensive fibers on the body side of the fabric. These fabrics thus provide the requisite protection to the wearer while rendering the garment more comfortable and affordable as compared to existing fabrics. The cost of the fabrics is contained due to (among other things): (1) incorporation of cellulosic fibers in the first yarns and inclusion of large amounts of cellulosic fibers in the second yarns; (2) limiting the amount of inherently FR fibers (more expensive fibers such as aramid fibers) in the fabric but concentrating those fibers on the face of the fabric; (3) inclusion of inherently FR fibers, which permits lower weight (and thus less expensive) fabrics to perform as required; (4) use of more modacrylic fibers than aramid fibers, which are significantly less expensive while still imparting thermal and arc protection to the fabric; and/or (5) use of AC fibers in the first yarns so as to be predominantly exposed on the face side of the fabric where the AC fibers are more effective for improving ATPV than if they were exposed on the body side of the fabric.

Table 1 sets forth testing results of various properties of some embodiments of the inventive fabrics contemplated herein (Fabrics 1-5). Fabrics 1-5 were finished but without the use of any property-imparting (e.g., flame retardant) additive.

TABLE 1

| Property | Fabric 1 | Fabric 2 | Fabric 3 | Fabric 4 | Fabric 5 | | |
|---|---|---|---|---|---|---|---|
| First Yarn Blend | 55 Protex A/35 Tencel/ 5 Meta/ 5 Para | 55 Protex A/30 Tencel/ 10 Meta/ 5 Para | 60 Protex A/25 Tencel/ 10 Meta/ 5 Para | 60 Protex A/28 Tencel/ 7 Meta/ 5 Para | 70 Protex A/10 Tencel/ 10 Meta/ 10 Para | | |
| Second Yarn Blend | 80 Tencel/ 17 Protex C/3 Para | 80 Tencel/ 17 Protex C/3 Para | 80 Tencel/ 17 Protex C/3 Para | 80 Tencel/ 17 Protex C/3 Para | 70 Tencel/ 25 Meta/ 5 Para | NFPA 70E/ ASTM 1506 Requirement | NFPA 2112 Requirement |
| Weave | 2 × 1 RHT | 2 × 1 RHT | 2 × 1 RHT | 2 × 1 RHT | 2 × 1 RHT | | |
| Width Overall (in) | 61.8 | 62.2375 | 61.075 | 62.25 | 62.275 | | |
| Width Inside Pins (in) | 60.98 | 61.06 | 60.48 | 61.28 | 61.36 | | |
| Weight (osy) | 6 | 5.9 | 5.9 | 5.8 | 5.7 | | |
| Construction (w × f) | 64 × 52 | 64 × 50 | 65 × 50 | 65 × 50 | 76 × 56 | | |
| Vertical Flammability - Before Wash | | | | | | | |
| After Flame (sec) | 0 × 0 | 0 × 0 | 0 × 0 | 0 × 0 | 0 × 0 | <2 × 2 | <2 × 2 |
| Char Length (inch) | 3.4 × 2.9 | 3.5 × 2.5 | 3.6 × 2.5 | 3.6 × 2.9 | 2.0 × 2.9 | <6 × 6 | <4 × 4 |
| After Glow (sec) | 3 × 3 | 2 × 2 | 2 × 2 | 2 × 2 | 2 × 2 | | |
| Vertical Flammability - After 100x IL* | | | | | | | |
| After Flame (sec) | 0 × 0 | 0 × 0 | 0 × 0 | 0 × 0 | 0 × 0 | | <2 × 2 |
| Char Length (inch) | 3.4 × 3.4 | 3.5 × 2.2 | 3.9 × 2.2 | 3.3 × 2.6 | 2.0 × 3.3 | | <4 × 4 |
| After Glow (sec) | 8 × 7 | 7 × 6 | 7 × 7 | 7 × 7 | 5 × 6 | | |
| Tensile Strength (lbf) | 99 × 93 | 107 × 79 | 114 × 96 | 112 × 91 | 110 × 95 | 30 × 30 | |
| Elmendorf Tear (lbf) | 9.8 × 10 | 11.5 × 10.4 | 12.0 × 10.2 | 10.8 × 10.5 | 8.6 × 7.7 | 2.5 × 2.5 | |
| Laundry Shrinkage (%) - After 5x PP120** | −5.3 × −6.5 | −4.0 × −6.4 | −4.2 × −5.4 | −4.2 × −6.5 | −3.0 × −1.8 | | |
| Thermal Shrinkage (%) | | | | | | | |
| Before Wash | −8.4 × −4.3 | −7.1 × −4.8 | −8.1 × −5.3 | −8.3 × −5.5 | −7.1 × −2.6 | | <10 × 10 |
| After 3x IL | −8.2 × −5.3 | −6.1 × −5.2 | −7.5 × −5.1 | −7.4 × −5.2 | −5.4 × −3.0 | | <10 × 10 |
| Air permeability (cfm/ft$^2$) | 144 | 161 | 142 | 154 | 99 | | |
| HTP- Before Wash (cal/cm$^2$) | | | | | | | |
| with Spacer | 10.3 | 10.2 | 10.3 | 10.3 | 9.8 | | >6 |
| w/o Spacer | 7.3 | 7.3 | 7.1 | 7.2 | 6.8 | | >3 |

TABLE 1-continued

| Property | Fabric 1 | Fabric 2 | Fabric 3 | Fabric 4 | Fabric 5 | |
|---|---|---|---|---|---|---|
| HTP-After 3x IL (cal/cm$^2$) | | | | | | |
| with Spacer | 12.3 | 12 | 11.4 | 11.8 | 11 | >6 |
| w/o Spacer | 8.7 | 8.1 | 8.2 | 8.6 | 7.6 | >3 |
| Wicking Droplet Test (s) | | | | | | |
| Before Wash | 0.5 | 0.5 | 0.4 | 0.4 | 0.7 | |
| After 5x PP120 | 0.8 | 0.9 | 0.9 | 1 | 2.5 | |
| Arc Rating (cal/cm$^2$) | 8 | 8.6 | 8.1 | 8.3 | 8.5 | |

*The fabrics were laundered in accordance with the industrial laundering ("IL") specifications set forth in NFPA 2112.

**The fabrics were laundered in accordance with AATCC Method 135, 3, IV, A iii (*Dimensional Changes of Fabrics after Home Laundering*, 2018 edition, incorporated herein by reference). More specifically, the fabrics were laundered via permanent press at 120° F. ("PP120").

Vertical flammability (char length, after flame, and after glow) were tested in accordance with ASTM D6413*: Standard Test Method for Flame Resistance of Textiles* (*Vertical Test*) (2015 edition). Tensile strength was tested in accordance with D5034*: Standard Test Method for Breaking Strength and Elongation of Textile Fabrics* (*Grab Test*) (2009 edition), and the results are represented in pounds force ("lbf"). Elmendorf tear strength was tested in accordance with ASTM D1424*: Standard Test Method for Tearing Strength of Fabrics by Falling-Pendulum* (*Elmendorf-Type*) *Apparatus* (2009 edition), and the results are represented in pounds force ("lbf"). Laundry shrinkage was tested in accordance with AATCC Method 135, 3, IV, A iii: *Dimensional Changes of Fabrics after Home Laundering* (2018 edition). Thermal shrinkage was tested in accordance with NFPA 2112. Heat transfer performance/radiant heat resistance ("HTP") was tested in accordance with ASTM F1939*: Standard Test Method for Radiant Heat Resistance of Flame Resistant Clothing Materials with Continuous Heating* (2015 edition), and the results are reported in calories per centimeter$^2$. All of these testing methodologies are incorporated herein by reference.

Embodiments of the fabrics disclosed herein comply with the vertical flammability requirements of both ASTM F1506 (char length of 6 inches or less and a two second or less afterflame) and NFPA 2112 (char length of 4 inches or less and a two second or less afterflame), when measured pursuant to the testing methodology set forth in ASTM D6413, as well as the thermal shrinkage requirement (no more than 10% thermal shrinkage) of NFPA 2112.

Moreover, many of the inventive fabrics achieved an arc rating (ATPV or $E_{BT}$) greater or equal to 8 cal/cm$^2$ so as to have a PPE Category 2 rating under NFPA 70E even at low weights (e.g., between 5-7 osy, inclusive). Embodiments of the fabrics disclosed herein achieve surprisingly high arc rating/fabric weight ratios. In some embodiments, the arc rating/fabric weight ratio is 1.1-1.6, inclusive; 1.2-1.6, inclusive; 1.3-1.6, inclusive; 1.4-1.6, inclusive; and 1.4-1.5, inclusive. In some embodiments, the arc rating/fabric weight ratio is at least 1.2; at least 1.25; at least 1.3; at least 1.35; at least 1.4; at least 1.45; at least 1.5; at least 1.55; and/or at least 1.6. Even higher arc rating/fabric weight ratios may be achieved by increasing the amount of AC fibers (FR or non-FR) in the blend.

Incorporation of cellulosic and modacrylic fibers in the fiber blends impart excellent moisture management properties to the fabric when tested pursuant to AATCC 79*: Absorbency of Textiles* (2018 edition, incorporated herein by reference). In other words, the fabrics are able to quickly draw moisture away from the wearer's body via capillary action. Under AATCC 79, a droplet of water is deposited on the fabric surface, and the time it takes for the droplet to absorb fully into the fabric is measured. Some embodiments of the fabrics contemplated herein achieve an absorbency time of 5 seconds or less when tested pursuant to AATCC 79, as evidenced in Tables 1-4 (see "Wicking Droplet Test"). Such testing is to be performed on unfinished fabrics as the wicking property of a fabric can be easily manipulated with the use of finishes.

In addition to wicking ability, the air permeability of the fabric is also relevant to the comfort of the fabric. The air permeability of a fabric is determined by test method ASTM D737*: Standard Test Method for Air Permeability of Textile Fabrics* (2018 edition, incorporated herein by reference) and gauges how easily air passes through a fabric. The fabric is placed on a device that blows air through the fabric, and the device measures the volume flow of air through the fabric at a particular pressure (reported as "f$^3$/min/ft$^2$" or cubic foot per minute per square foot). Higher air permeability values mean that the fabric is more breathable, which is typically desirable. Embodiments of the fabric contemplated herein have good air permeability (in the range of 80-250 f$^3$/min/ft$^2$, inclusive; 90-200 f$^3$/min/ft$^2$, inclusive; 100-150 f$^3$/min/ft$^2$, inclusive) when tested pursuant to ASTM D737.

The fabrics described herein can be incorporated into any type of single or multi-layer garment (uniforms, shirts, jackets, trousers and coveralls) where protection against electric arc flash and/or flames is needed and/or desirable.

EXAMPLES

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A fabric formed by first yarns and a second yarns, wherein the fabric has a first side and a second side opposite the first side and wherein: the first yarns comprise a first fiber blend comprising aramid fibers, modacrylic fibers, and cellulosic fibers; the aramid fibers and the modacrylic fibers of the first fiber blend constitute at least 50% of the first fiber blend; the first fiber blend comprises more modacrylic fibers than aramid fibers; the second yarns comprises a second fiber blend that is different from the first fiber blend and that comprises aramid fibers, modacrylic fibers, and cellulosic fibers; the second fiber blend comprises at least 60% cellulosic fibers; the second fiber blend comprises more modacrylic fibers than aramid fibers; the first yarns are predominantly exposed on the first side of the fabric; the second yarns are predominantly exposed on the second side of the fabric; the fabric has a char length of at least 6 inches and an afterflame of 2 seconds or less when tested pursuant to ASTM D6413 (2015); the fabric has a fabric weight between 5 to 7 ounces per square yard, inclusive; and the fabric has an arc rating of at least 8 cal/cm$^2$ when tested pursuant to ASTM F1959 (2014).

Example 2. The fabric of any of the preceding or subsequent examples or combination of examples, wherein the aramid fibers and the modacrylic fibers of the first fiber blend constitute at least 60% of the first fiber blend.

Example 3. The fabric of any of the preceding or subsequent examples or combination of examples, wherein the first fiber blend comprises up to 2 times more modacrylic fibers than aramid fibers.

Example 4. The fabric of any of the preceding or subsequent examples or combination of examples, wherein the first fiber blend comprises up to 3 times more modacrylic fibers than aramid fibers.

Example 5. The fabric of any of the preceding or subsequent examples or combination of examples, wherein the first fiber blend comprises approximately 5-25% aramid fibers, 50-80% modacrylic fibers, and 15-40% cellulosic fibers.

Example 6. The fabric of any of the preceding or subsequent examples or combination of examples, wherein the cellulosic fibers in the first fiber blend are non-FR lyocell fibers.

Example 7. The fabric of any of the preceding or subsequent examples or combination of examples, wherein the modacrylic fibers in the first fiber blend are additive-containing fibers.

Example 8. The fabric of any of the preceding or subsequent examples or combination of examples, wherein the aramid fibers in the first fiber blend comprise meta-aramid fibers and para-aramid fibers.

Example 9. The fabric of any of the preceding or subsequent examples or combination of examples, wherein the second fiber blend comprises at least 70% cellulosic fibers.

Example 10. The fabric of any of the preceding or subsequent examples or combination of examples, wherein the modacrylic fibers and aramid fibers of the second fiber blend constitute 40% or less of the second fiber blend.

Example 11. The fabric of any of the preceding or subsequent examples or combination of examples, wherein the fabric is a woven fabric comprising a first fabric direction and a second fabric direction opposite the first fabric direction, wherein the first yarns are provided only in the first fabric direction and the second yarns are provided only in the second fabric direction.

Example 12. A garment formed with the fabric of any of the preceding or subsequent examples or combination of examples, the garment having a face side and a body side, wherein the first side of the fabric is exposed on the face side of the garment and the second side of the fabric is exposed on the body side of the garment.

Example 13. A fabric formed by first yarns and a second yarns, wherein the fabric has a first side and a second side opposite the first side and wherein: the first yarns comprise a first fiber blend comprising aramid fibers, modacrylic fibers, and cellulosic fibers; the aramid fibers and the modacrylic fibers of the first fiber blend constitute at least 70% of the first fiber blend; the first fiber blend comprises more modacrylic fibers than aramid fibers; the second yarns comprises a second fiber blend that is different from the first fiber blend and that comprises aramid fibers and non-FR cellulosic fibers; the second fiber blend is devoid of modacrylic fibers; the second fiber blend comprises at least 50% non-FR cellulosic fibers; the first yarns are predominantly exposed on the first side of the fabric; the second yarns are predominantly exposed on the second side of the fabric; the fabric has a char length of at least 6 inches and an afterflame of 2 seconds or less when tested pursuant to ASTM D6413 (2015); the fabric has a fabric weight between 5 to 7 ounces per square yard, inclusive; and the fabric has an arc rating of at least 8 cal/cm$^2$ when tested pursuant to ASTM F1959 (2014).

Example 14. The fabric of any of the preceding or subsequent examples or combination of examples, wherein the aramid fibers and the modacrylic fibers of the first fiber blend constitute at least 80% of the first fiber blend.

Example 15. The fabric of any of the preceding or subsequent examples or combination of examples, wherein the first fiber blend comprises up to 3 times more modacrylic fibers than aramid fibers.

Example 16. The fabric of any of the preceding or subsequent examples or combination of examples, wherein the first fiber blend comprises approximately 5-30% aramid fibers, 50-80% modacrylic fibers, and 10-40% cellulosic fibers.

Example 17. The fabric of any of the preceding or subsequent examples or combination of examples, wherein the second fiber blend comprises at least 60% non-FR cellulosic fibers.

Example 18. The fabric of any of the preceding or subsequent examples or combination of examples, wherein the aramid fibers of the second fiber blend constitute 40% or less of the second fiber blend.

Example 19. The fabric of any of the preceding or subsequent examples or combination of examples, wherein the fabric is a woven fabric comprising a first fabric direction and a second fabric direction opposite the first fabric direction, wherein the first yarns are provided only in the first fabric direction and the second yarns are provided only in the second fabric direction.

Example 20. A garment formed with the fabric of any of the preceding or subsequent examples or combination of examples, the garment having a face side and a body side, wherein the first side of the fabric is exposed on the face side of the garment and the second side of the fabric is exposed on the body side of the garment.

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A fabric formed by first yarns and second yarns, wherein the fabric has a first fabric side and a second fabric side opposite the first fabric side and wherein:

i. the first yarns comprise a first fiber blend comprising aramid fibers, modacrylic fibers, and 5-15% cellulosic fibers;

ii. the aramid fibers and the modacrylic fibers of the first fiber blend constitute at least 70% of the first fiber blend;

iii. the first fiber blend comprises more modacrylic fibers than aramid fibers;

iv. the second yarns comprise a second fiber blend that is different from the first fiber blend and that comprises aramid fibers and non-FR cellulosic fibers;

v. the second fiber blend is devoid of modacrylic fibers;

vi. the second fiber blend comprises at least 50% non-FR cellulosic fibers;

vii. the first yarns are predominantly exposed on the first fabric side;

viii. the second yarns are predominantly exposed on the second fabric side;

ix. the fabric has a char length of 6 inches or less and an afterflame of 2 seconds or less when tested pursuant to ASTM D6413 (2015);

x. the fabric has a fabric weight between 5 to 7 ounces per square yard, inclusive; and xi. the fabric has an arc rating of at least 8 cal/cm$^2$ when tested pursuant to ASTM F1959 (2014).

2. The fabric of claim 1, wherein the aramid fibers and the modacrylic fibers of the first fiber blend constitute at least 80% of the first fiber blend.

3. The fabric of claim 1, wherein the first fiber blend comprises up to 3 times more modacrylic fibers than aramid fibers.

4. The fabric of claim 1, wherein the first fiber blend comprises approximately 5-30% aramid fibers, 50-80% modacrylic fibers, and 10-15% cellulosic fibers.

5. The fabric of claim 1, wherein the second fiber blend comprises at least 60% non-FR cellulosic fibers.

6. The fabric of claim 1, wherein the aramid fibers of the second fiber blend constitute 40% or less of the second fiber blend.

7. The fabric of claim 1, wherein the fabric is a woven fabric comprising a first fabric direction and a second fabric direction opposite the first fabric direction, wherein the first yarns are provided only in the first fabric direction and the second yarns are provided only in the second fabric direction.

8. A garment formed with the fabric of claim 1 and having a face side and a body side, wherein the first fabric side is exposed on the face side of the garment and the second fabric side is exposed on the body side of the garment.

9. A fabric formed by first yarns and second yarns and comprising a first fabric direction, a second fabric direction opposite the first fabric direction, a first fabric side, and a second fabric side opposite the first fabric side, wherein:

i. the first yarns comprise a first fiber blend comprising approximately 5-30% aramid fibers, 50-80% modacrylic fibers, and 5-15% cellulosic fibers;

ii. the aramid fibers and the modacrylic fibers of the first fiber blend constitute at least 70% of the first fiber blend;

iii. the first fiber blend comprises more modacrylic fibers than aramid fibers;

iv. the second yarns comprises a second fiber blend that is different from the first fiber blend and that comprises aramid fibers and non-FR cellulosic fibers;

v. the second fiber blend is devoid of modacrylic fibers;

vi. the second fiber blend comprises at least 50% non-FR cellulosic fibers;

vii. the aramid fibers of the second fiber blend constitute 40% or less of the second fiber blend;

viii. the first yarns are predominantly exposed on the first fabric side and the second yarns are predominantly exposed on the second fabric side;

ix. the first yarns are provided only in the first fabric direction and the second yarns are provided only in the second fabric direction;

x. the fabric has a char length of 6 inches or less and an afterflame of 2 seconds or less when tested pursuant to ASTM D6413 (2015);

xi. the fabric has a fabric weight between 5 to 7 ounces per square yard, inclusive; and xii. the fabric has an arc rating of at least 8 cal/cm$^2$ when tested pursuant to ASTM F1959 (2014).

* * * * *